US005675556A

United States Patent [19]

Erath et al.

[11] Patent Number: 5,675,556

[45] Date of Patent: Oct. 7, 1997

[54] HYDROPHONE STRUCTURE AND METHOD

[75] Inventors: Louis W. Erath, Abbeville, La.; Gary Craig, Houston, Tex.

[73] Assignee: Syntron, Inc., Houston, Tex.

[21] Appl. No.: 545,111

[22] Filed: Oct. 19, 1995

[51] Int. Cl.[6] ..... H04R 17/00

[52] U.S. Cl. ..... 367/166

[58] Field of Search ..... 367/166, 157, 367/159, 162, 163, 165, 188; 310/337

[56] References Cited

U.S. PATENT DOCUMENTS

| | | | |
|---|---|---|---|
| 3,187,300 | 6/1965 | Brate | 310/337 |
| 3,988,620 | 10/1976 | McDavid | 367/155 |
| 4,017,824 | 4/1977 | Fife et al. | 367/155 |
| 4,174,503 | 11/1979 | Merklinger et al. | 330/300 |
| 4,464,739 | 8/1984 | Moorcroft | 367/130 |
| 4,509,037 | 4/1985 | Harris | 340/347 |
| 4,799,201 | 1/1989 | Nelson | 367/41 |
| 4,833,659 | 5/1989 | Geil et al. | 367/155 |
| 4,876,675 | 10/1989 | Ogura et al. | 367/155 |
| 4,977,546 | 12/1990 | Flatley et al. | 367/140 |
| 5,029,147 | 7/1991 | Andrews et al. | 367/134 |
| 5,051,799 | 9/1991 | Paul et al. | 375/25 |
| 5,193,077 | 3/1993 | Weiglein et al. | 367/23 |
| 5,335,548 | 8/1994 | Kalibjian | 73/655 |
| 5,363,344 | 11/1994 | Sofen | 367/157 |
| 5,541,894 | 7/1996 | Erath | 367/157 |

OTHER PUBLICATIONS

Piezotronic Technical Data,Brush Electronics Company, 1952, pp. 1–27.

Material Description and Typical Applications, pp. 12–13.

IEEE Standard on Piezoelectricity, Copyright 1978 by The Institute of Electrical and Electronics, Engineers, Inc., pp. 1–55.

*Primary Examiner*—Daniel T. Pihulic

*Attorney, Agent, or Firm*—Gunn & Associates, P.C.

[57] ABSTRACT

A hydrophone structure comprises a hydrophone casing within which is mounted a conductive substrate. Sound pressure signals are conducted into the interior of the substrate, on which are mounted piezoelectric crystals on the exterior of the substrate. The volume between the casing and the substrate is nearly filled with a fluid, preferably oil. One or more bubbles of air remain in the volume between the casing and the substrate to permit vibration of the substrate and consequently the piezoelectric hydrophone element.

15 Claims, 3 Drawing Sheets

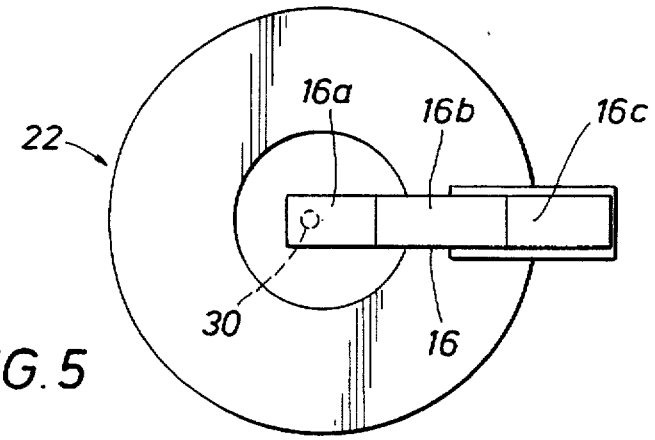
FIG. 5
FIG. 6
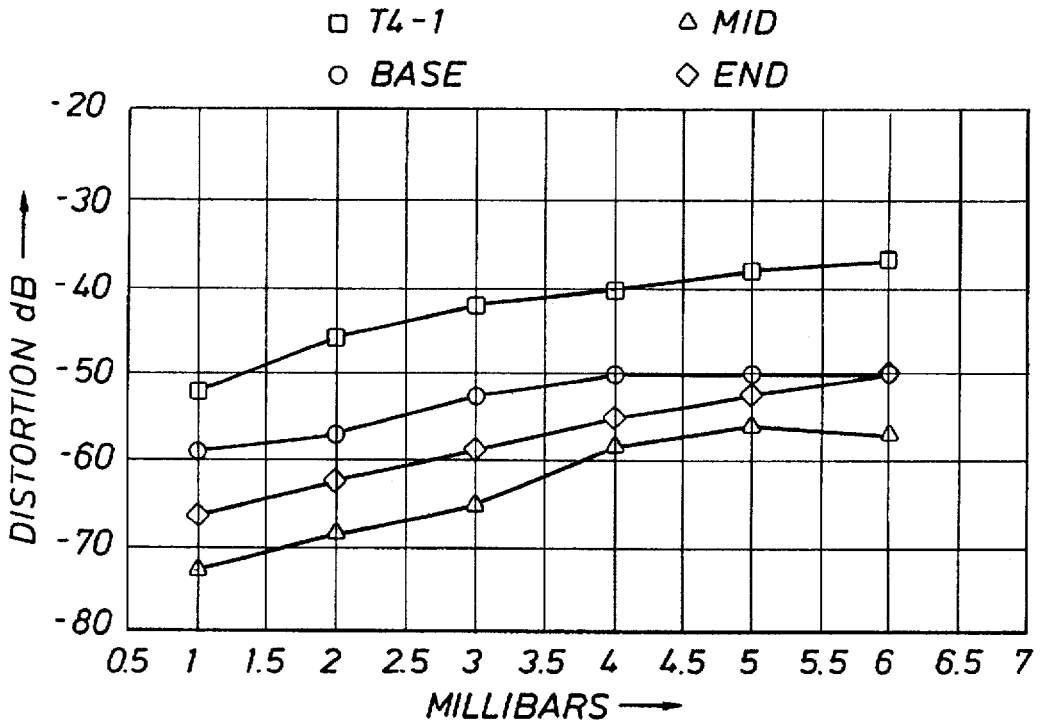
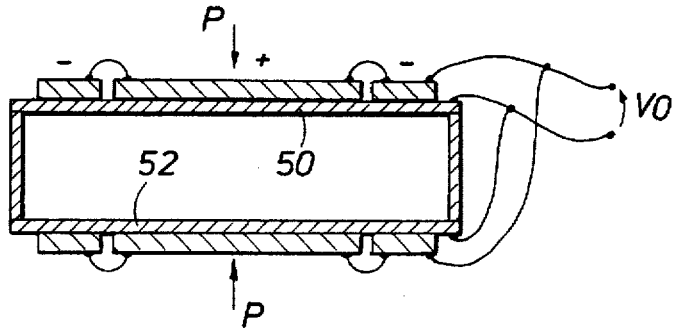
FIG. 8

FIG. 7
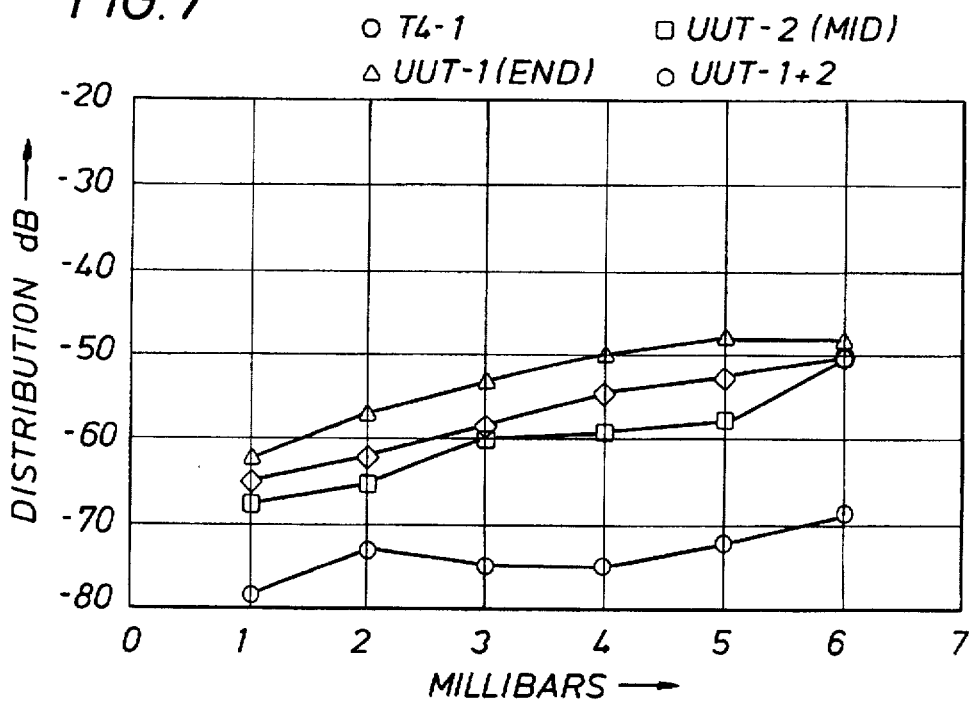
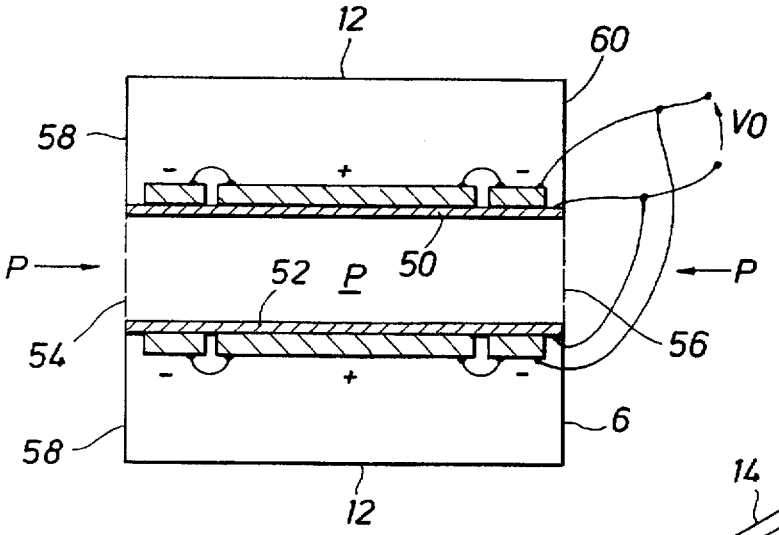
FIG. 9
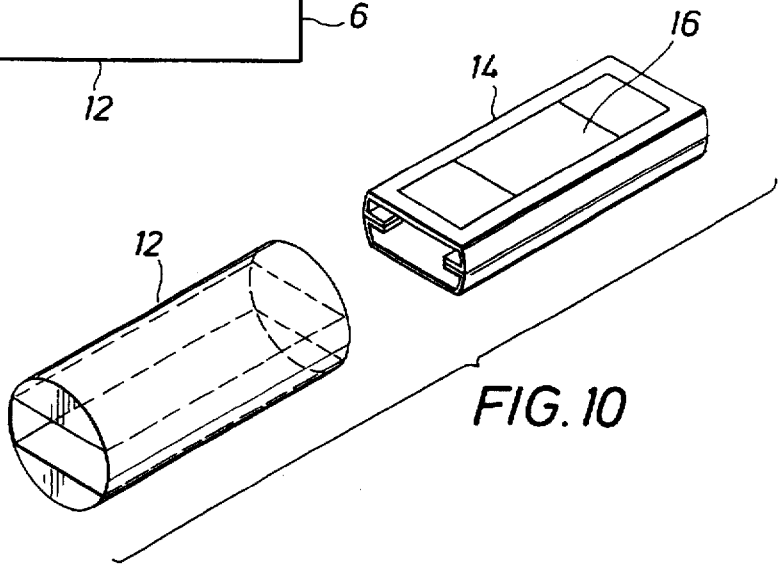
FIG. 10

HYDROPHONE STRUCTURE AND METHOD

This application is related to concurrently filed application Ser. No. 08/545,342 pending entitled Segmentation and Polarization in a Hydrophone Crystal, assigned to the same assignee as the present application.

FIELD OF THE INVENTION

The present invention relates generally to the field of hydrophones and, more particularly, to a new hydrophone and to a method and system for mounting a low-distortion hydrophone element in a durable and inexpensive structure.

BACKGROUND OF THE INVENTION

Piezoelectric transducers for a variety of applications, including hydrophones, are well known. Piezoelectric devices respond to an application of stress, such as externally applied pressure as from a sound signal, to develop an electrical potential. Conversely, piezoelectric devices develop a mechanical response when a voltage is applied. The behavior and characteristics of piezoelectric materials is well described in *IEEE Standard on Piezoelectricity*, 1978, incorporated herein by reference.

The earliest such applications for transducers were entirely analog. With the advent of digital technology, however, digital techniques were soon applied to signal detection and processing. This digital technology, in general, is capable of higher resolution than the previous analog techniques.

The earliest digital signal acquisition and processing data rates were extremely slow, and had fewer bits per sample, compared with the state of the art today. With slow bit rates, distortion produced by the piezoelectric crystals was relatively insignificant. In this context, the term "distortion" refers to the increasing significance of harmonics, particularly the second harmonic, compared to the fundamental of the signal, with increasing signal output.

As stress on a piezoelectric device increases, the amplitudes of the harmonics produced by the crystal increase at a rate that is faster than the rate of increase in the amplitude of the fundamental. Furthermore, as digital signal processing has increased in speed and resolution, the distortion of the signal from the harmonics has become more and more important. The clarity and resolution is thus dependent more and more on the signal from the transducer being relatively undistorted.

In certain applications such as seismic applications, noise from the background and other sources is of much higher amplitude than the return signal of interest. A variety of techniques, such as correlation, have been developed to extract the reflected, desired signal from this background noise. The non-linearity in the signal from the crystal will cause inter-modulation between the background noise and the desired signal. In other words, the desired signal will be amplitude modulated by the much larger noise signal, generating new families of modulation products, complicating the filtering process.

Equipment improvements in data rate, resolution, and linearity bring better definition in resultant profiles, to the point that non-linearity and distortion from the transducer contribute most of the signal error. That means that an improvement in the accuracy of the transducer brings an immediate improvement in signal quality.

A further difficulty lies in the fact that, since there is no perfect transducer, there is no standard against which to measure the distortion from a transducer. This is illustrated in FIG. 10, page 36, in the previously mentioned *IEEE Standard on Piezoelectricity*.

Thus, there remains a need for a method and system to eliminate or at least minimize the effects of signal distortion from the active element in a transducer, such as a piezoelectric device. Such a method and system should eliminate the distortion effects of the piezoelectric device, despite the non-linearity of the element itself. The system should be self-contained and not have to rely on any other signal processing steps or other active elements such as transistors.

A viable solution to these and other problems was disclosed in co-pending application Ser. No. 08/452,386 now U.S. Pat. No. 5,541,894 entitled Low Distortion Hydrophone. In this disclosure, a first piezoelectric element is mounted so as to receive a pressure signal. A second piezoelectric element is provided with a means of receiving and enhancing the same pressure signal. Since a piezoelectric element is a capacitor, another capacitor is coupled in parallel with the second element to serve as a divider. The output voltage of the combination of the two elements is taken as the difference between the positive terminals of the two elements. Thus, the effect of the pressure enhancer and capacitance divider is to provide a difference in potential between the fundamentals from the two elements, while rendering the amplitude of the second harmonics equal. The two equal second harmonics cancel each other out at the output terminals, at at least one pressure, while retaining a useful fundamental for further signal processing.

This disclosed improved hydrophone presents at least two draw-backs. First, it calls for distinct capacitive elements in addition to the piezoelectric crystal. Further, it calls for separate structure to enhance the pressure signal on a piezoelectric element. Thus, there remains a need for a hydrophone structure that eliminates the need for such separate elements.

It has also been found that the electrical signal attributable from various regions of a piezoelectric crystal varies according to the degree of stress impressed upon that region of the crystal. The recognition of this phenomenon should provide an opportunity to combine signals from different regions of the crystal to reduce distortion of the signal from higher order harmonics. This feature has been developed in co-pending application Ser. No. 08/545,342 pending entitled Segmentation and Polarization in a Hydrophone Crystal, filed concurrently herewith and incorporated by reference.

In use hydrophones are commonly towed in an array. The array comprise, for example, twelve streamers towed in parallel behind a vessel, with as many as three thousand hydrophones in a streamer, which itself may be one hundred meters long. In a streamer, hydrophones are positioned within a hydrophone cable, which comprises a hollow tube with a wall thickness of about ¼". Tensile strength is provided to the hydrophone cable by braided cable within the hollow tube, and the hydrophones are commonly stacked end-to-end within the hydrophone cable.

This towed array system develops significant hydrodynamic drag against the vessel towing the array. If the diameter of the streamers, and therefore the hydrophones, could be reduced, the drag would also be reduced.

Further, hydrophones are subjected to substantial hydraulic pressure when submerged. It would therefore be advantageous to provide a hydrophone structure that is as robust as possible to withstand the tremendous hydraulic pressures, while still remaining sensitive to minor variations is pressure due to sound signals.

SUMMARY OF THE INVENTION

The present invention provides a new hydrophone structure that comprises primarily a hydrophone casing within which is mounted a conductive substrate. Sound pressure signals are conducted into the interior of the substrate, on which are mounted piezoelectric crystals on the exterior of the substrate. The volume between the casing and the substrate is nearly filled with a fluid, preferably oil. One or more bubbles of air remain in the volume between the casing and the substrate to permit vibration of the substrate and consequently the piezoelectric hydrophone element.

This structure provides a hydrophone that is both compact and robust to the harsh underwater environment.

The present invention preferably employs a segmented piezoelectric hydrophone crystal. The segments of the crystal located on the ends of the crystal, while receiving the same acoustic pressure signal, experience a greater degree of flexing forces and thus deliver a greater relative secondary (and higher) harmonic signal per unit area. By carefully selecting the area of the end segments, and electrically coupling the segments so that the harmonics of the various segments are added out of phase, the distortion introduced the harmonics of the various phases subtract.

This feature is conveniently introduced by mounting a piezoelectric material upon a conductive substrate, and then etching the material into selected regions or segments. The center segment, which provides most of the fundamental signal, is polarized in a first direction by the introduction of a polarizing voltage. The end segments are polarized in the opposite direction by the imposition of a polarizing voltage in the opposite direction. The conductive substrate then serves as one terminal of the output of the hydrophone while the upper surfaces of the segments together serve as the other terminal. The relative strengths of the signals from the segments may tailored by adjusting the areas of the segments.

The present invention thus provides a new hydrophone element and structure, as well as a method of making the hydrophone structure. These and other features of the present invention will be readily apparent to those of skill in the art from a review of the following detailed description along with the accompanying drawings.

BRIEF DESCRIPTION OF THE DRAWINGS

FIG. 5 is a top view of the test rig of FIG. 3.

FIG. 6 is a plot of the test results of a segmented crystal element, built in accordance with the present invention, showing distortion vs. pressure.

FIG. 7 is a plot of the test results of another segmented crystal element, built in accordance with the present invention, showing distortion vs. pressure and further showing the effects of coupling the segments as depicted in FIGS. 4, 8, and 9.

FIG. 8 is a side view of a hydrophone with a segmented crystal of the present invention mounted to either side of a conductive substrate comprising a hydrophone mounting structure.

FIG. 9 is a side view of a hydrophone with a segmented crystal of the present invention mounted to either side of a mounting structure as shown in FIGS. 2*a* and 2*b*.

FIG. 10 is an exploded, perspective view depicting the installation of a mounting structure within a hydrophone casing, as shown in FIG. 1 and also showing the placement of a hydrophone crystal on the mounting structure.

DETAILED DESCRIPTION OF A PREFERRED EMBODIMENT

Figure 1:
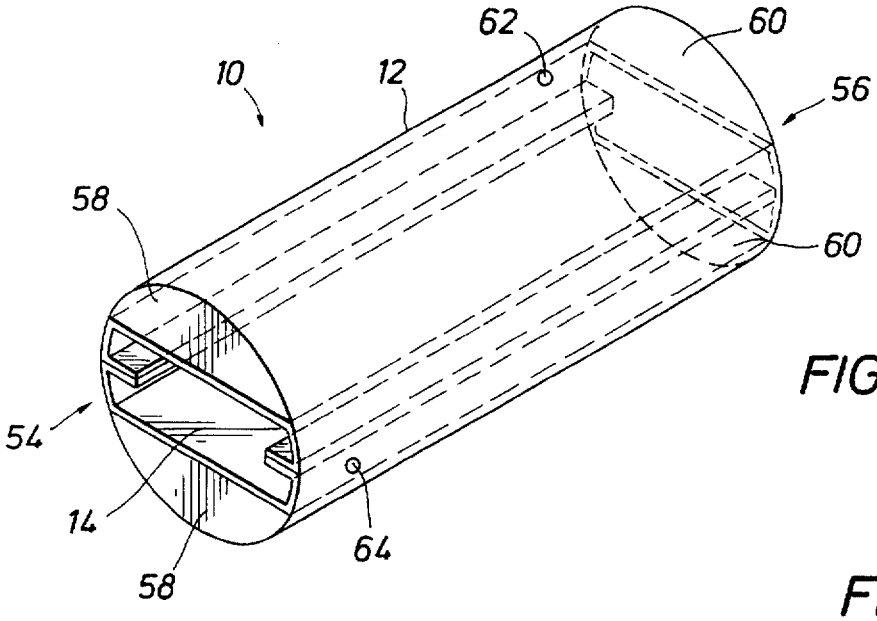
FIG. 1 is a perspective view of a hydrophone casing and mounting structure to which the hydrophone transducer of the present invention may be mounted.

Referring first to FIG. 1, a hydrophone structure 10 of the present invention is depicted. The structure 10 comprises primarily a casing 12 and a support element 14, which holds the piezoelectric crystal of the hydrophone. As shown in FIG. 10, the support element 14 is configured to fit within the casing 12 and to support a crystal element 16.

Figure 2B:
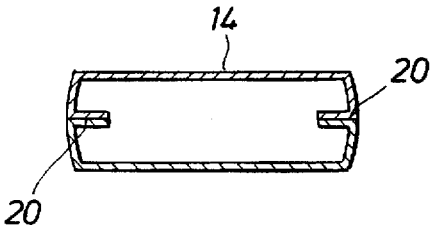
FIG. 2*b* is a section view of another hydrophone mounting structure.
Figure 2A:
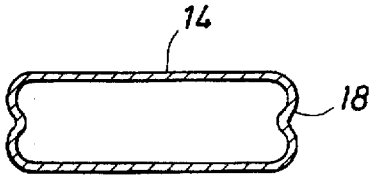
FIG. 2*a* is a section view of a hydrophone mounting structure.

FIGS. 2*a* and 2*b* depict cross sections of a preferred support element 14. FIG. 2*a* depicts a solid, extruded form of the support element and this form may be extruded in the form illustrated or, in the alternative, it may be extruded as a cylindrical tube and then forced under pressure to the substantially rectangular form. In either case, the form depicted in FIG. 2*a* includes a flexible wall member 18 that helps to eliminate non-signal vibrations that may be imparted to the hydrophone crystal mounted on the element 14.

Alternatively, rather than being formed from an extrusion as shown in FIG. 2*a*, the support element 14 may be formed of two simple plates, bent and joined together as shown in FIG. 2*b*. This embodiment of the support element has the advantage of simple constituents but has the drawbacks (1) an additional manufacturing step of joining the two pieces and (2) a seam 20 which must serve as a pressure boundary.

Figure 3:
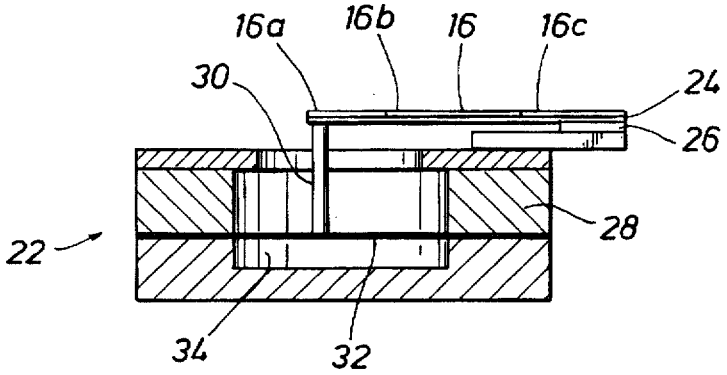
FIG. 3 is a side view of a test rig for testing the segmented piezoelectric hydrophone crystal of the present invention.

FIGS. 3–7 illustrate preferred embodiments of a piezoelectric crystal that may find application to the structure of the present invention, along with results of testing the embodiments. FIGS. 3 and 5 depict a test rig to test the effectiveness of the new crystal to reduce distortion in a hydrophone and FIG. 6 depicts the test results from this test rig.

Referring to FIGS. 3 and 5, a piezoelectric element was constructed and mounted to a test structure 22. This device is referred to as Device No. 1 in Table 1. Such a piezoelectric crystal element may be acquired from EDO in Salt Lake City, Utah.

A piezoelectric element 16 is placed on a conductive substrate 24, preferably by mounting the crystal on the support structure with a conductive epoxy. The element 16 may then be etched to separate the element into at least two and preferably three segments 16*a*, 16*b*, and 16*c*. The segment 16*a* may be referred to herein as the end segment or unit under test 1 (UUT-1). The segment 16*b* may be referred to as the mid segment or unit under test 2 (UUT-2). Segment 16*c* may be referred to as the base.

The base 16*c* is mounted to a pedestal 26 which in turn is mounted to a test rig body 28. The end segment 16*a* is attached to a diaphragm rod 30 which connects the element 16 to the upper side of a diaphragm 32. On the opposite side of the diaphragm is a chamber 34 which permits the diaphragm to freely flex in the presence of a sound pressure signal.

The mid segment 16b is polarized in a first direction by the application of a polarizing voltage, for example 300 VDC. It is known that the application of such a voltage for a sufficient period of time will polarize a piezoelectric material indefinitely. The end segment 16a and the base segment 16c are similarly polarized, but in the opposite direction, by the application of a polarizing voltage in the opposite direction. The polarized segments are then individually coupled to outputs to determine the distortion from each.

Application of various pressure signals to the device shown in FIG. 3 resulted in the plot shown in FIG. 6. The shaded square data points were obtained from a standard Teledyne T4-1 hydrophone, which was used as a reference for illustration purposes only. For these tests, the distortion was defined as the fraction of the second harmonic relative to the entire signal from the hydrophone. As shown in FIG. 6, in general, the distortion from the various segments and from the reference increases with increasing pressure signal.

Further, it should be noted that the mid segment 16b has the lowest distortion at every pressure. This is because it has been recognized that the end segment 16a and the base segment 16c experience greater stress than the mid segment 16b and thus contribute relatively more distortion than the mid segment. By segmenting or segregating the higher stress regions of the crystal element from the lower stress region, overall distortion is reduced.

Measured test results from Device Number 1 are shown below in Table 1.

TABLE 1

(Device Number 1)

| MB | T4-1 | Base | Mid | End | MV Base | MV Mid | MV End | MV T4-1 |
|---|---|---|---|---|---|---|---|---|
| 6 | −50 | −50 | −57 | −36 | 330 | 215 | 32 | 226 |
| 5 | −52 | −50 | −55 | −38 | 272 | 183 | 28 | 190 |
| 4 | −55 | −50 | −58 | −40 | 225 | 147 | 22 | 153 |
| 3 | −59 | −53 | −64 | −42 | 170 | 110 | 17 | 115 |
| 2 | −62 | −57 | −68 | −46 | 112 | 74 | 11 | 77 |
| 1 | −66 | −59 | −72 | −52 | 56 | 37 | 5.7 | 38 |
| | | | Capacitance (nf) | | | | | |
| | | 11.0 | 11.1 | 9.2 | | | | |
| | | | Sensitivity (V/BAR) | | | | | |
| | | 56 | 40.3 | 7 | | | | |

Figure 4:
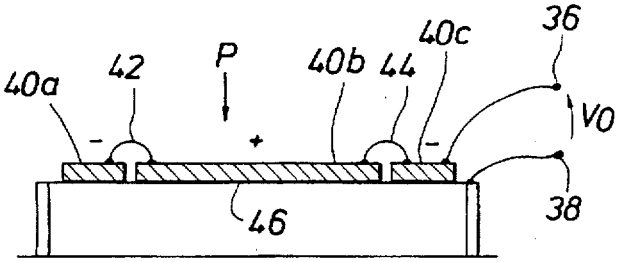
FIG. 4 is a side view of the segmented hydrophone crystal depicting electrical coupling of the segments.

It has also been recognized that the signals produced by the end and base segments are of opposite polarity from those of the mid segment. If the segments are coupled together as shown in FIG. 4, and the areas of the various segments are carefully controlled so that the second harmonic tends to cancel, significantly reduced distortion results. It should be appreciated that, in the end and base segments, the second harmonic is relatively greater than in the mid segment. Thus, while the second harmonics from the end and base segments tend to cancel out the second harmonic from the mid segment, the fundamental from the end and base segments are relatively less significant and do not cancel out the fundamental from the mid segment.

Thus, a Device number 2 was constructed and tested. The test results are depicted below in Table 2.

TABLE 2

(Device Number 2)

| MB | T4-1 | End | Mid | End + Mid |
|---|---|---|---|---|
| 6 | −50 | −48 | −50 | −68 |
| 5 | −53 | −48 | −57 | −72 |
| 4 | −55 | −50 | −59 | −75 |
| 3 | −59 | −53.5 | −60 | −75 |
| 2 | −62 | −57 | −65 | −73 |
| 1 | −66 | −63 | −68 | −78 |

Capacitance of UUT-1 (Unit Under Test No. 1 or End segment) and UUT-2 (Mid segment) are both 18.7 nf.
Sensitivity of UUT-1 = −195.9 dB or 16.03245 V/BAR
Sensitivity of UUT-2 = −187.2 dB or 43.65158 V/BAR Note that, for the purposes of this test, only the signals from the end segment (UTT-1) and mid segment (UTT-2). The test results, shown graphically in FIG. 7, illustrate significantly reduced distortion when the signals are added (180° out of phase).

FIGS. 4–6 depict preferred embodiments for the arrangement of the crystal segments. In these Figures, the thickness of the crystal element and the etched gaps between the segments are exaggerated for ease of illustration.

In FIG. 4, a segment 40a and a segment 40c are polarized in the opposite direction from a segment 40b. The segments are then coupled by jumpers 42 and 44. One terminal 36 of the transducer is taken from the upper surface of the crystal and the other terminal 38 is taken from a conductive substrate 46. The substrate 46 may also be mounted to and insulated from a separate diaphragm element.

It has been found that having a transducer element mounted to one side of the diaphragm may cause undesirable acceleration effects, such as those caused by motion of the hydrophone in addition to the vibrating motion of the diaphragm. To eliminate these acceleration effects, a piezoelectric element may be added to the underside of the diaphragm as well, as shown in FIG. 8. The various segments of the crystal elements so formed may then be electrically coupled as shown.

Referring now to FIGS. 1, 9, and 10, it is preferred to mount the piezoelectric crystal element of the present invention to the support structure shown in cross section in FIGS. 2a and 2b. The section view of FIG. 9 is along the longitudinal axis of the support structure while the section views of FIGS. 2a and 2b are along the transverse axes of those embodiments, respectively.

A feature of the assembly of FIGS. 1, 9, and 10, in contrast to the embodiments heretofore described, it that the pressure signal is conducted within the support structure. The support structure defines an upper wall 50, on which is mounted a set of crystal segments, and a lower wall 52, on which is mounted another set of crystal segments. The segments are then electrically coupled as illustrated in FIG. 9. The sound pressure signal is conducted from outside the hydrophone through openings 54 and 56, into the interior of the hydrophone. When the hydrophone is assembled as shown in FIG. 1, the support structure 14 is preferably sealed to the casing 12 by end-plates 58 and 60. The volume between the casing 12 and the support structure 14 may then be (almost) filled with a fluid, such as oil. To accommodate the sound signal and permit the piezoelectric elements to flex, a small air bubble 62 acts as a cushion. If there is no fluid communication between the chambers above and below the support structure, another bubble 64 acts a cushion to permit flexing of the crystal segments on the underside of the support structure.

It should also be understood that the present invention is equally applicable to a structure in which the piezoelectric crystal is mounted to an electrode which is electrically insulated from the support structure. The advantage of such an arrangement is that a short circuit to the support structure remains insulated from the crystal and its mounting electrode.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A hydrophone comprising:

a. a substantially cylindrical casing;

b. an electrically conductive support element within the casing, the support element defining a sound conductive channel through the support element, wherein the casing and the support element define a volume therebetween;

c. a piezoelectric crystal on the support element outside the channel, the crystal defining a first surface in contact with the support element and a second surface opposite the support element;

d. a first output terminal of the transducer electrically coupled to the support element; and e. a second output terminal of the transducer electrically coupled to the second surface.

2. The hydrophone of claim 1, wherein the volume is substantially filled with a fluid, except for an air bubble.

3. The hydrophone of claim 1, wherein the support element defines a substantially rectangular cross section with opposed upper and lower walls and opposed side walls between the upper and lower walls.

4. The hydrophone of claim 3, wherein the crystal is mounted on the upper wall.

5. The hydrophone of claim 4, further comprising:

a. a second crystal mounted on the lower wall outside the channel, the second crystal defining a third surface in contact with the support element and a fourth surface opposite the support element;

b. wherein the third surface is electrically coupled to the first output terminal; and c. wherein the fourth surface is electrically coupled to the second output.

6. The hydrophone of claim 1 further comprising an opening to conduct a sound signal into the channel.

7. A hydrophone comprising:

a. a substantially cylindrical casing;

b. an electrically conductive support element within the casing, the support element defining a sound conductive channel through the support element;

c. a segmented piezoelectric crystal on the support element, the crystal defining a first surface in contact with the support element and a second surface opposite the support element, wherein a first segment of the crystal is polarized in a direction opposite to that of a second segment of the crystal;

d. a first output terminal of the transducer electrically coupled to the support element; and e. a second output terminal of the transducer electrically coupled to the second surface.

8. The hydrophone of claim 7, wherein the support element defines a substantially rectangular cross section with opposed upper and lower walls and opposed side walls between the upper and lower walls.

9. The hydrophone of claim 8, wherein the crystal is mounted on the upper wall.

10. The hydrophone of claim 9, further comprising:

a. a second crystal mounted on the lower wall outside the channel, the second crystal defining a third surface in contact with the support element and a fourth surface opposite the support element;

b. wherein the third surface is electrically coupled to the first output terminal; and c. wherein the fourth surface is electrically coupled to the second output.

11. The hydrophone of claim 7, further comprising an opening to conduct a sound signal into the channel.

12. A hydrophone transducer comprising:

a. a support element defining a sound conductive channel;

b. an electrode mounted on and insulated from the support element outside the channel;

c. a piezoelectric crystal mounted to the electrode, the crystal defining a first surface toward the support element and a second surface opposite the support element;

d. a first output terminal of the transducer electrically coupled to the electrode; and e. a second output terminal of the transducer electrically coupled to the second surface.

13. The transducer of claim 12, wherein the support element defines a substantially rectangular cross section with opposed upper and lower walls and opposed side walls between the upper and lower walls.

14. A hydrophone support structure comprising:

a. an open-ended sound conductive channel with top and bottom electrically conductive support substrates, each of the substrates adapted to support a piezoelectric element outside of the channel;

b. a substantially cylindrical casing, the channel and the casing defining a volume therebetween; and c. an end plate at each end of the casing to seal the volume between the channel and the casing, each of the end plates having an opening to receive a sound signal into the channel.

15. The hydrophone support structure of claim 14, wherein the volume is substantially filled with a fluid, except for an air bubble.

* * * * *